US008634581B2

(12) United States Patent
Rosenkranz

(10) Patent No.: US 8,634,581 B2
(45) Date of Patent: Jan. 21, 2014

(54) METHOD AND DEVICE FOR ESTIMATING INTERFERENCE NOISE, HEARING DEVICE AND HEARING AID

(75) Inventor: Tobias Rosenkranz, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 45 days.

(21) Appl. No.: 13/397,859

(22) Filed: Feb. 16, 2012

(65) Prior Publication Data

US 2012/0213395 A1 Aug. 23, 2012

Related U.S. Application Data

(60) Provisional application No. 61/443,896, filed on Feb. 17, 2011, provisional application No. 61/445,162, filed on Feb. 22, 2011.

(30) Foreign Application Priority Data

Feb. 17, 2011 (DE) ..... 10 2011 004 338

(51) Int. Cl.
*H04R 25/00* (2006.01)

(52) U.S. Cl.
USPC ..... 381/317; 381/94.1; 381/320

(58) Field of Classification Search
USPC ..... 381/58, 60, 312, 317, 320, 321, 94.1, 381/94.2, 94.7; 704/226, 227, 233
See application file for complete search history.

(56) References Cited

U.S. PATENT DOCUMENTS

| | | | | |
|---|---|---|---|---|
| 8,385,572 | B2 * | 2/2013 | Dreßler et al. | 381/317 |
| 2008/0140396 | A1 * | 6/2008 | Grosse-Schulte et al. | 704/227 |
| 2009/0252358 | A1 | 10/2009 | Dressler et al. | |

FOREIGN PATENT DOCUMENTS

| | | | |
|---|---|---|---|
| DE | 102008017550 | A1 | 10/2009 |
| EP | 2109329 | A2 | 10/2009 |
| WO | 2009043066 | A1 | 4/2009 |

OTHER PUBLICATIONS

Martin: "Noise Power Spectral Density Estimation Based on Optimal Smoothing and Minimum Statics", IEEE Transactions on Speech and Audio Processing, vol. 9, No. 5, Jul. 2001, pp. 504-512.
Vuorela-Vepsalainen, et al: Vascular Endothelical Growth Factor is Bound in Amniotiv Fluid and Maternal Serum, Human Reproduction, vol. 14, No. 5, 1998, pp. 1346-1351.
Rosenkranz: "Noise Codebook Adaptation for Codebook-Based Noise Reduction", International Workshop on Acoustic Echo and Noise Control, 2010.
Haensler, et al: "Acoustic Echo and Noise Control: A Practical Approach: Chapter 13.4.1.2 Estimation of the Local Background Noise Power", Wiley Interscience, 2004, p. 320.

* cited by examiner

*Primary Examiner* — Huyen D Le
(74) *Attorney, Agent, or Firm* — Laurence A. Greenberg; Werner H. Stemer; Ralph E. Locher

(57) ABSTRACT

In order to enable better estimation of dynamic interference noise, a device and a method for estimating interference noise provide a value for the power density of a total signal, containing a wanted signal and the interference noise to be estimated, in a current time window. The value of the total signal is compared with an estimated value, multiplied with an amplification factor, of interference noise from a time window prior to the current time window and the smaller of the two values from the comparison is used as a preliminary estimated value for the interference noise in the current time window. A codebook estimated value for the interference noise in the current time window is also provided. Finally, the larger of the preliminary estimated value and the codebook estimated value is used as the estimated value for the interference noise in the current time window.

10 Claims, 3 Drawing Sheets

METHOD AND DEVICE FOR ESTIMATING INTERFERENCE NOISE, HEARING DEVICE AND HEARING AID

CROSS-REFERENCE TO RELATED APPLICATION

This application claims the benefit, under 35 U.S.C. §119 (e), of provisional patent application No. 61/443,896, filed Feb. 17, 2011, and of provisional patent application No. 61/445,162, filed Feb. 22, 2011; this application also claims the priority, under U.S.C. §119, of German patent application DE 10 2011 004 338.1, filed Feb. 17, 2011; the prior applications are herewith incorporated by reference in their entirety.

BACKGROUND OF THE INVENTION

Field of the Invention

The present invention relates to a method for estimating interference noise by providing a value for the power density of a total signal, containing a useful signal and the interference noise to be estimated, in a current time window, comparing the value of the total signal with an estimated value, multiplied with an amplification factor, of interference noise from a time window prior to the current time window and using the smaller of the two values from the comparison as a preliminary estimated value for the interference noise in the current time window. The present invention additionally relates to a device for estimating interference noise in an input device for the provision of the value for the power density of the total signal and a recursive minimum estimation device for the comparison of the value of the total signal with the estimated value of the previous time window. The present invention furthermore relates to a hearing device with such a device for estimating interference noise. A hearing device in the present context is understood to be any sound-emitting device that can be worn in or on the ear, in particular a hearing aid, a headset, headphones and the like.

Hearing aids are wearable hearing devices used to help people who are hard of hearing. Hearing aids are made available in various designs, including behind-the-ear (BTE) hearing aids, receiver in the canal (RIC) hearing aids and in the ear (ITE) hearing aids, for example also concha hearing aids and in the canal hearing aids (ITE, CIC), in order to meet the wide range of different user requirements. The hearing aids mentioned as examples are worn on the external part of the ear or in the auditory canal. However other aids to hearing, including bone conduction aids to hearing and implantable and vibrotactile aids to hearing, are also available in the market. The damaged hearing is stimulated either mechanically or electrically with these devices.

The primarily important components of a hearing aid are in principle an input transducer, an amplifier and an output transducer. The input transducer is generally a sound receiver, for example a microphone, and/or an electromagnetic receiver, such as, for example, an induction coil. The output transducer is usually realized as an electroacoustic transducer, for example a miniature loudspeaker, or as an electromechanical transducer, for example a bone vibrator. The amplifier is ordinarily integrated into a signal processing unit. This design in principle is illustrated in FIG. 1 using the example of a behind-the-ear hearing aid. One or more microphones 2 are installed in a hearing aid housing 1 to be worn behind the ear. The microphones 2 are to receive sound from the environment. A signal processing unit (SPU) 3, which is likewise integrated into the hearing aid housing 1, processes and amplifies the microphone signals. The output signal from the signal processing unit 3 is transmitted to a loudspeaker or bone vibrator 4, which outputs an acoustic signal. The sound may be transmitted to the eardrum of the hearing aid wearer via an acoustic tube secured in the auditory canal by means of an ear mold. The power supply for the hearing aid and in particular for the signal processing unit 3 comes from a battery (BAT) 5 that is likewise integrated in the hearing aid housing 1.

In many applications, especially in the case of hearing aids and cellular telephones, the wanted signal, which is usually speech, is often affected by interference noise. While stationary interference noise generally does not cause much of a problem for known speech enhancement systems, non-stationary interference noise is usually more of a challenge. Single-channel (that is to say only a single microphone is used), model-based speech enhancement systems, which are also expected to suppress highly non-stationary interference noise, are particularly affected. Such single-channel speech enhancement systems can make the listener's life easier by appropriately attenuating interference noise.

Single-channel interference noise reduction is typically performed by what are known as Wiener filters. When creating a Wiener filter, it is necessary at least to estimate the interference noise power spectral density (PSD). Conventional speech enhancement systems customarily presuppose that the interference noise tends to be stationary, that is to say the characteristic of the interference noise changes only slowly over time. The interference noise characteristics can accordingly be estimated during breaks in speech, which, however, demands robust voice activity detection (VAD).

More sophisticated methods operate according to the "minimum statistic" or "minimum tracking" principle. They are able to update the interference noise estimate even during voice activity and thus do not need VAD. The minimum statistic method breaks noisy speech down into sub-bands and searches for minima in these sub-bands within a certain period of time. Due to the highly dynamic nature of the voice signal, the minima should correspond to the noise spectral power density if the noise or interference noise is sufficiently stationary. The minima are used as input variables for the generation of an amplification factor in the relevant frequency band. The method fails, however, if the interference noise is too non-stationary. This means that its performance plummets in highly non-stationary environments (for example chat in a cafeteria). Reference is made in respect of interference noise reduction by means of what are known as "recursive minimum tracking" and "minimum statistic" to the book by Eberhard Hänsler and Gerhard Schmidt titled "Acoustic Echo and Noise Control: A Practical Approach", Wiley-Interscience-Verlag, 2004 and to the article by R. Martin titled "Noise Power Spectral Density Estimation Based on Optimal Smoothing and Minimum Statistics", IEEE Transactions on Speech and Audio Processing, 2001, 9 (5), pages 504 to 512.

Speech enhancement techniques known as "codebook-based" techniques have recently been developed. These techniques make use of prior knowledge about speech and interference noise. The principal idea behind them is to estimate the spectral envelope and the wide-band signal powers (amplification factors) of speech and interference noise from the noise-affected signal. Typical spectral envelopes of speech and different categories of interference noise are stored in codebooks. The first step in estimation is to take a pair (one speech entry and one interference noise entry) of spectral envelopes from the corresponding codebooks. The optimal amplification factors (that is to say the wide-band speech power and the wide-band interference noise power) are estimated by maximizing a specific optimization criterion. One criterion, for example, is that the sum of the speech and interference noise codebook entries corresponds as far as possible to the current noise-affected signal. In a second step, either the pair (together with the associated estimated amplification factors) that corresponds with the highest probability to the current noise-affected spectrum is selected or each pair is weighted with the probability that it corresponds to the current noise-affected sound spectrum and all of the pairs thus weighted are added together. By this means estimated values are obtained for the speech and interference noise components of the noise-affected sound spectrum. These estimated values are used as input variables for a subsequent interference noise reduction operation, for example using a Wiener filter. This estimation method is carried out in short time windows (for example 8 ms) so that rapid changes in the interference noise characteristic can be tracked virtually without delay. A minimum statistic estimator can track such changes only with a delay in the range of a few seconds.

Such a codebook-based algorithm is known from the article by T. Rosenkranz titled "Noise Codebook Adaptation for Codebook-Based Noise Reduction", in Proceedings of the International Workshop on Acoustic Echo and Noise Control (IWAENC), Tel Aviv, August 2010.

There are, however, also three serious disadvantages to the codebook-based approach. Firstly, interference noise estimation is limited to a predefined set of codebook entries. These entries represent spectral envelopes, so they are smoothed along the frequency axis. This means that sharp spectral peaks, for example, are not modeled. Secondly, the ability of the codebook-based approach to respond to changes in interference noise without delay means that the estimate fluctuates strongly. The estimate of the wide-band level is quite naturally not perfect and consequently fluctuates relatively strongly about the true value, which leads to unpleasant artifacts in the signal produced after interference noise removal. Thirdly, this codebook-based approach cannot cope with any categories of noise for which it has not been trained.

SUMMARY OF THE INVENTION

It is accordingly an object of the invention to provide a method and device for estimating noise signals which overcome the above-mentioned disadvantages of the heretofore-known devices and methods of this general type and which provides for a method and a device with which it is possible to estimate even unfamiliar interference noise as quickly as possible.

With the foregoing and other objects in view there is provided, in accordance with the invention, a method for estimating interference noise, the method comprising:

providing a value for the power density of a total signal, containing a wanted signal and the interference noise to be estimated, in a current time window;

comparing the value of the total signal with an estimated value, multiplied by an amplification factor, of interference noise from a time window prior to the current time window;

using the smaller of the two values in the comparing step as a preliminary estimated value for the interference noise in the current time window;

providing a codebook estimated value for the interference noise in the current time window; and using the greater of the preliminary estimated value and the codebook estimated value as the estimated value for the interference noise in the current time window.

In other words, the objects of the invention are achieved, according to the invention, by a method for estimating interference noise in which a codebook estimated value is provided for the interference noise in the current time window and in which the greater of a preliminary estimated value and the codebook estimated value is used as the estimated value for the interference noise in the current time window.

With the above and other objects in view there is also provided, in accordance with the invention, a device for estimating interference noise which comprises:

an input device to provide a value for the power density of a total signal, containing a wanted signal and the interference noise to be estimated, in a current time window;

a recursive minimum estimation device to compare the value of the total signal with an estimated value, multiplied with an amplification factor, of interference noise from a time window previous to the current time window and to output the smaller of the two values from the comparison as a preliminary estimated value for the interference noise in the current time window;

a codebook estimation device to provide a codebook estimated value for the interference noise in the current time window; and a logic device connected to the recursive minimum estimation device and to the codebook estimation device and configured to determine the larger of the previous estimated value and the codebook estimated value as the estimated value for the interference noise in the current time window.

The "recursive minimum tracking" and the "codebook-based interference noise estimation" techniques are thus combined according to the invention in an advantageous manner in order to achieve improved reduction of non-stationary interference noise. The aforementioned disadvantages of recursive minimum searching and the disadvantages of codebook-based estimation as such are thereby essentially eliminated.

The value for the total signal and the estimated value for interference noise are preferably spectral values. Signal processing in the method according to the invention is then performed in the spectral range.

It is particularly favorable for the method to be applied in multiple frequency channels in parallel. The input signal is for this purpose advantageously broken down into the various spectral components in a filter bank.

It is also advantageous for the estimated value for the interference noise in the current time window to be smoothed with the estimated value from the previous time window. This is favorable insofar as it does not result in any excessive jumps in the noise reduction.

It is also particularly advantageous if the codebook estimated value can temporarily be set to zero. The equivalent effect can be achieved by switching off the codebook estimation device. This makes the entire algorithm less sensitive to whether the interference noise is known or not.

In an advantageous application, the method for estimating interference noise outlined above is used to reduce interference noise. It is again particularly advantageous here for such a method for reducing interference noise to be used to operate a hearing aid or to be implemented in a hearing aid. This enables hearing aid wearers in particular to benefit from the improved, combined interference noise reduction method.

The aforementioned device for estimating interference noise can be integrated into a hearing device. In a most preferred embodiment, this hearing device is implemented as a hearing aid.

Other features which are considered as characteristic for the invention are set forth in the appended claims.

Although the invention is illustrated and described herein as embodied in a method and device for estimating an interference noise, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments presented in greater detail below represent preferred implementations of the present invention.

Figure 1:
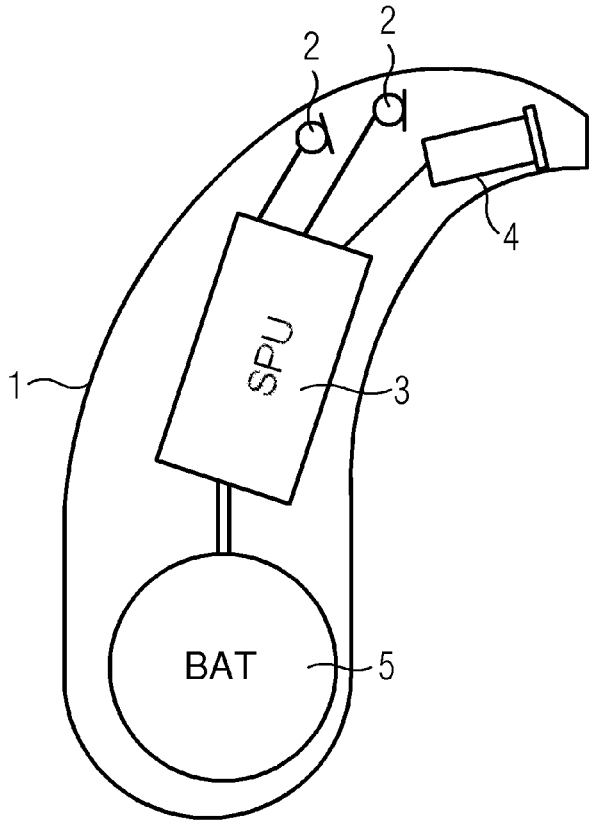
FIG 1 (Prior Art)
FIG. 1 shows a schematic diagram of a hearing aid according to the prior art.
Figure 2:
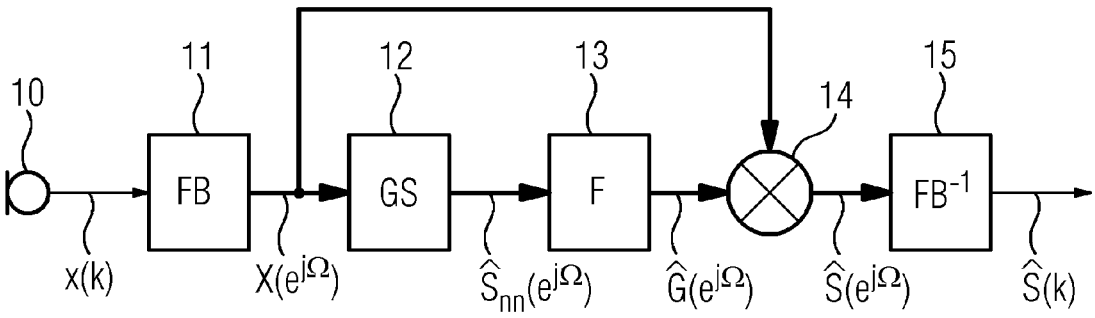
FIG. 2 shows a circuit diagram of a signal processing arrangement in a hearing aid.

Referring now to the figures of the drawing in detail, where a hearing aid is illustrated as an exemplary embodiment, signal processing is performed in accordance with the diagram in FIG. 2. A microphone 10 of the hearing aid supplies a noisy or noise-affected signal x(k). This signal is broken down spectrally into various frequency bands with the aid of a filter bank (FB) 11. A spectral signal $X(e^{j\Omega})$ is thus made available. This spectral signal is fed to a noise estimating unit 12 that acquires from it an estimated value $\hat{S}_{nn}(e^{j\Omega})$ for the noise power density. A noise reduction filter (F) 13 determines therefrom spectral weights $\hat{G}(e^{j\Omega})$. The weights $\hat{G}(e^{j\Omega})$ are then multiplied in a multiplier 14 with the spectrum $X(e^{j\Omega})$ of the total signal to produce an estimated value $\hat{S}(e^{j\Omega})$ for the wanted signal (for example a clean speech signal), which may also be referred to as a useful signal or a desired signal. An estimate $\hat{s}$ (k) of the wanted signal in the time domain is created by means of an inverse filter bank ($FB^{-1}$) 15.

The noise estimate is now optimized according to the invention in the noise estimation unit 12. According to the invention, a noise estimation algorithm based on the recursive minimum statistic and an algorithm based on one or more codebooks are combined. This yields a noise estimation method that combines the corresponding advantages. For example, a codebook-based algorithm as described in the article by T. Rosenkranz, supra, used. The noise estimate of the codebook-based algorithm is integrated into the recursive estimation algorithm based on the minimum statistic approach similar to the algorithm of Eberhard Hänsler and Gerhard Schmidt, supra.

Figure 3:
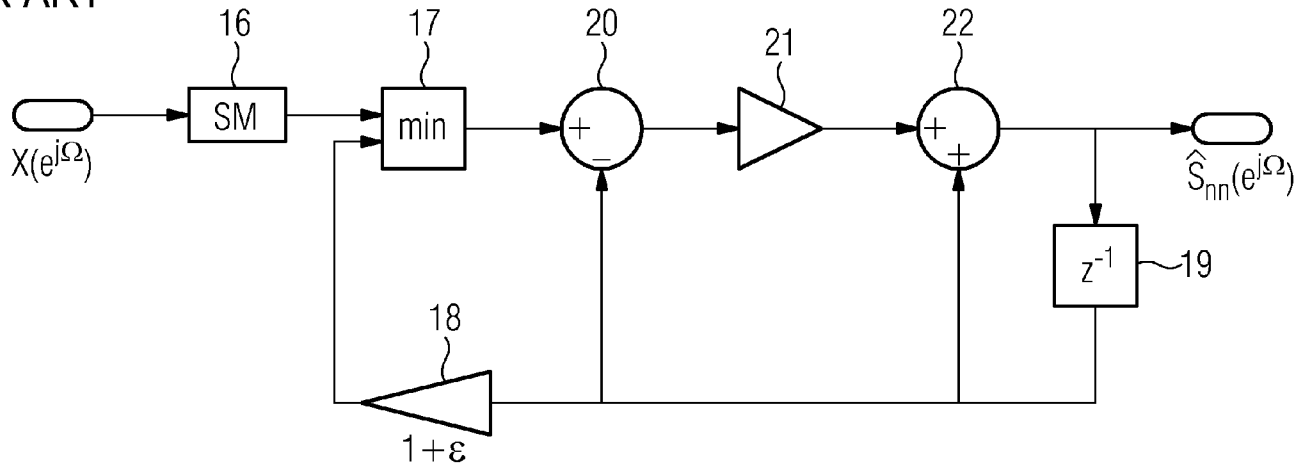
FIG 3 PRIOR ART
FIG. 3 shows a circuit diagram of a recursive interference noise estimator according to the prior art.

A model of a recursive interference noise estimator is presented below with reference to FIG. 3 to help make the invention more understandable. The method shown there is performed in multiple frequency (sub-)bands independently of one another. The individual frequency bands are obtained using the filter bank 11 shown in FIG. 2, for example. The input signal $X(e^{j\Omega})$ or $|X|^2$ is, by way of example, a periodogram of noisy speech. The output signal $\hat{S}_{nn}(e^{j\Omega})$ corresponds to an estimate of the interference noise power spectrum. The input signal is smoothed in a smoothing unit 16. The smoothed input spectrum is compared in a comparator 17 with the estimated interference noise spectrum of a previous window. The estimated interference power spectrum of the previous time window is for this purpose first multiplied with a constant "interference noise estimate amplification", which corresponds to the value $1+\epsilon$, where $\epsilon \ll 1$. The amplifier 18 is provided for this multiplication. It receives its input signal from a delay element 19, which for its part is fed by the estimated noise value $\hat{S}_{nn}(e^{j\Omega})$ for the current time window. The output signal is smoothed by subtracting the estimated value for the previous time window (signal after the delay unit 19) from the output signal of the comparator 17 in a subtractor 20. The difference signal is multiplied with a constant in a further amplifier 21. The resulting signal is finally added in an adder 22 to the estimated value for the previous time window, from which the smoothed estimated value $\hat{S}_{nn}(e^{j\Omega})$ finally results.

A first-order IIR (infinite impulse response) smoothing of the estimated interference noise spectrum is thus performed with the elements 19, 20, 21 and 22.

The minimum of the two signals (in the current time window and in the previous time window) is used in the comparator 17. This is thus a type of efficient implementation of the minimum statistic algorithm according to the article by R. Martin, supra.

Figure 5:
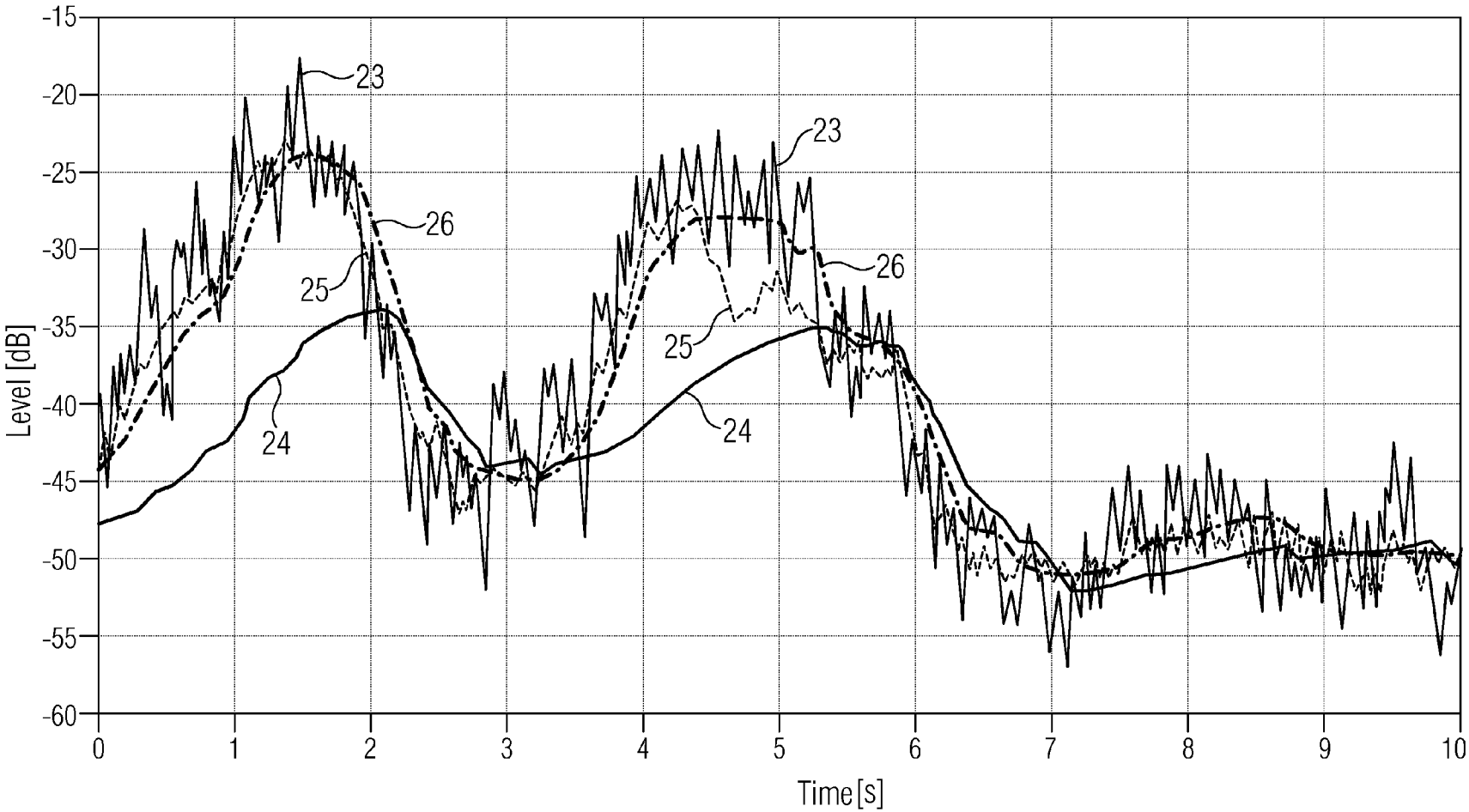
FIG. 5 shows signal waveforms of interference noise and interference noise estimates according to different algorithms.

The behavior of this known estimator can be seen in FIG. 5. The curve 23 shows the interference noise actually present. This interference noise is, by way of example, street noise with fast-moving passing automobiles. The estimated values are determined from a mixture of this interference noise with a speech signal at a signal-to-noise ratio (SNR) of 0 dB. The curve 24 shows the estimate of the recursive minimum tracking algorithm. As can be seen from the first two seconds of the estimate, for example, the estimator cannot follow the rapid increase in the interference noise. The increase of the estimator is limited by the constant $\epsilon$. This constant $\epsilon$ must be small, as otherwise the estimate would follow the noisy input spectrum too quickly, leading to speech components being incorrectly included in the interference noise estimate.

Figure 4:
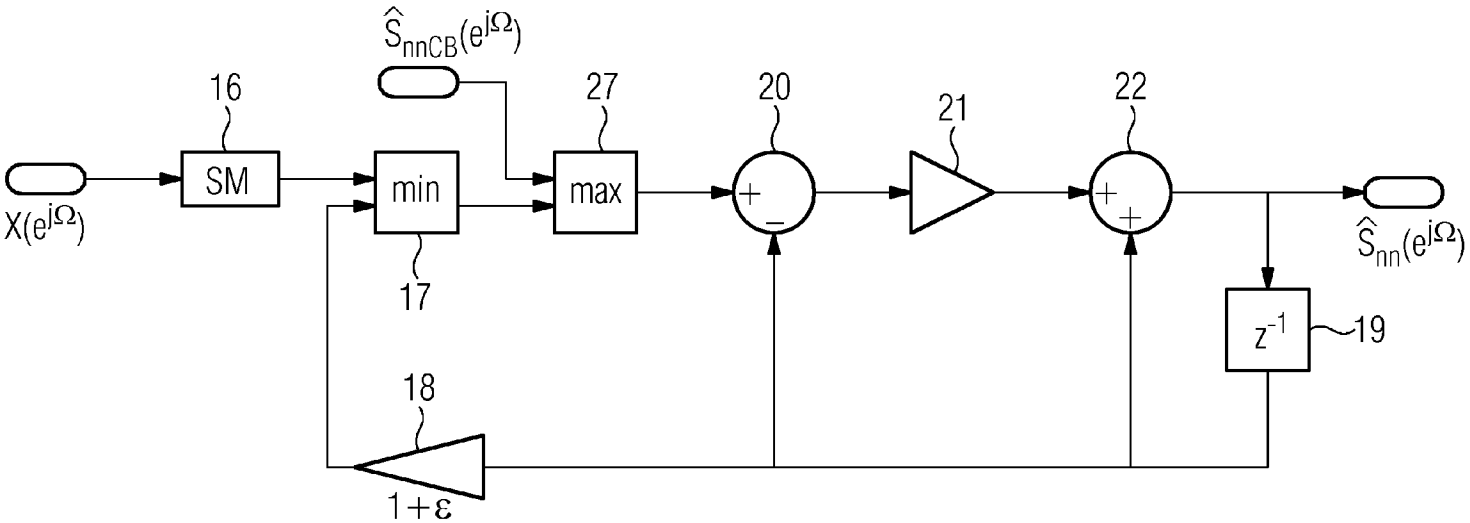
FIG. 4 shows a circuit diagram of a combined interference noise estimator according to the present invention.

Interference noise estimation is now improved according to the invention in accordance with the example shown in FIG. 4 by combining the recursive estimate with a codebook-based estimate, it being the case that the combined algorithm is able to follow rapid fluctuations in interference noise quickly. The signal flow diagram shown in FIG. 4 is essentially equivalent to that of FIG. 3. Reference is accordingly made to the description of FIG. 3. A codebook-based interference noise estimate is integrated into the estimating device with the aid of a maximum operation in a second comparator unit 27 (logic device) directly after the comparator unit 17 with the minimum operation. The comparator unit 27 receives a codebook estimate $\hat{S}_{nnCB}$ from a codebook estimating device that is not shown in greater detail in FIG. 4. If, accordingly, the actual interference noise is significantly underestimated (the estimated value of the recursive minimum tracking algorithm lies below that of the codebook-based algorithm), the codebook-based estimated value is taken. The recursive part of the algorithm is then able to follow the interference noise from a higher level. The combined algorithm according to the invention can thus respond to changes in the interference noise level just as quickly as codebook estimates.

FIG. 5 shows this behavior of the combined estimate. The codebook estimate is represented by curve 25. The estimate of the combined algorithm is reproduced in curve 26. Compared with the codebook estimate 25, the combined estimate 26 follows the increase in the interference noise level with a very small delay, which delay is attributable to the smoothing part 20, 21, 22 of the algorithm. It is evident, however, that the combined algorithm follows the increase in the interference noise level much more quickly than the recursive algorithm alone. It can also be seen that the combined algorithm according to the invention supplies a better estimate when the codebook-based estimate 25 underestimates the actual interference noise 23. Specifically, the codebook estimate 25 is clearly lower than the actual interference noise in the time range between 4 and 6 seconds. However, since the recursive part of the algorithm can follow the interference noise, the combined estimate 26 lies much closer to the real interference noise than the codebook-based estimate 25 or the recursive estimate 24 alone.

Thus a codebook-based interference noise estimate is advantageously combined with a recursive interference noise estimate. The advantages of each of these two estimates are accordingly acquired for the combination while minimizing the disadvantages.

The advantages of the combination reside in the fact that the combined algorithm is able to follow rapid fluctuations in interference noise much more quickly than conventional recursive interference noise estimators. Another advantage resides in the fact that with the codebook-based estimation algorithm incorporated in the manner proposed, the estimator becomes a conventional recursive estimator if the codebook-based estimate is switched off or set to zero. This in turn improves the robustness of the algorithm. A further advantage of the proposed combination resides in the fact that the algorithm can continue to follow the interference noise if the codebook-based algorithm underestimates the actual interference noise level. The combined algorithm can thus bridge areas in which the codebook-based estimation either underestimates the interference noise or is switched off. Moreover the noise estimate fluctuates much less than the codebook-based estimate alone, which results in much more pleasant sound reproduction with reduced artifacts. In addition the estimator proposed can cope with interference noise types for which the codebook-based algorithm has not been trained. This is due to the recursive part of the algorithm, which is independent of the codebook-based estimate.

The invention claimed is:

1. A method for estimating interference noise, the method comprising:

providing a value for the power density of a total signal, containing a wanted signal and the interference noise to be estimated, in a current time window;

comparing the value of the total signal with an estimated value, multiplied by an amplification factor, of interference noise from a time window prior to the current time window;

using the smaller of the two values in the comparing step as a preliminary estimated value for the interference noise in the current time window;

providing a codebook estimated value for the interference noise in the current time window; and using the greater of the preliminary estimated value and the codebook estimated value as the estimated value for the interference noise in the current time window.

2. The method according to claim 1, wherein each of the value of the total signal and the estimated value for the interference noise is a spectral value.

3. The method according to claim 1, which comprises smoothing the estimated value for the interference noise in the current time window with an estimated value from the previous time window.

4. The method according to claim 1, which comprises temporarily setting the codebook estimated value to zero.

5. The method according to claim 1 implemented in parallel in a plurality of frequency channels.

6. A method for reducing interference noise, the method comprising: estimating the interference noise by carrying out the method according to claim 1 and reducing the interference noise in accordance with the estimated value.

7. A method for operating a hearing aid, the method which comprises acquiring an input signal containing interference noise, carrying out the method according to claim 1 to thereby estimate the interference noise in the input signal, reducing the interference noise in accordance with an estimated value of the interference noise, and outputting an output signal with reduced interference noise.

8. A device for estimating interference noise, the device comprising:

an input device for providing a value for a power density of a total signal, containing a wanted signal and the interference noise to be estimated, in a current time window;

a recursive minimum estimation device for comparing the value of the total signal with an estimated value, multiplied by an amplification factor, of interference noise from a time window prior to the current time window and for outputting a smaller of the two values as a preliminary estimated value for the interference noise in the current time window;

a codebook estimation device for providing a codebook estimated value for the interference noise in the current time window; and a logic device connected to said recursive minimum estimation device and to said codebook estimation device for determining a greater of the preliminary estimated value for the interference noise and the codebook estimated value for the interference noise as an estimated value for the interference noise in the current time window.

9. A hearing device, comprising the device according to claim 8 for estimating an interference noise.

10. The hearing device according to claim 9 configured as a hearing aid.

* * * * *